US006053536A

United States Patent [19]

Clevenstine

[11] Patent Number: 6,053,536

[45] Date of Patent: Apr. 25, 2000

[54] PREPAID ADVERTISING COUPON ENVELOPE AND METHOD

[76] Inventor: Malcolm P. Clevenstine, 108 Island Estate Pkwy., Palm Coast, Fla. 32137

[21] Appl. No.: 09/076,228

[22] Filed: May 12, 1998

[51] Int. Cl.[7] ..... B42D 15/00

[52] U.S. Cl. ..... 283/116; 283/67; 283/70; 283/71

[58] Field of Search ..... 283/67, 70, 71, 283/116

[56] References Cited

U.S. PATENT DOCUMENTS 3,288,350 11/1966 Kushner .
3,334,806 8/1967 Hiersteiner .
3,460,743 8/1969 Burnett .
4,781,322 11/1988 Humm .
5,035,515 7/1991 Crossman et al. .
5,121,945 6/1992 Thomson et al. ..... 283/70
5,626,370 5/1997 Petkovsek ..... 283/116
5,684,291 11/1997 Taskett ..... 283/67

*Primary Examiner*—Willmon Fridie, Jr.
*Assistant Examiner*—Daniel Phan
*Attorney, Agent, or Firm*—Harpman & Harpman

[57] ABSTRACT

The present invention is directed to a method and apparatus for direct mail distribution of manufacturer and retailer's redeemable coupons using a prepaid mailing envelope. The multiple method steps of the invention includes preparing and selective distribution of prepaid mailing envelopes that are formed of paper blanks having a plurality of pre-purchased manufacturers redeemable coupons printed within.

5 Claims, 3 Drawing Sheets

PREPAID ADVERTISING COUPON ENVELOPE AND METHOD

BACKGROUND OF THE INVENTION

1. Technical Field

This invention relates to direct mail solicitation methods for distribution of advertisements and coupons offered by the manufacturer and/or retailer which are typically redeemable as part of the purchase price of the goods or services solicited.

2. Description of Prior Art

Prior art methods and apparatus of this type are used to advertise consumer products by use of direct mail campaigns. Typically, direct mail solicitation is achieved by mailing out large numbers of advertising material under "bulk" U.S. postal rates mailing process defined by the U.S. Postal Service. Such bulk mailings account for over 40% of the U.S. postal service revenue and help support the economic viability of first class mail and related U.S. postal services.

Heretofore advertisers have included coupons for unrelated goods and services in such mailings in an attempt to stimulate sales. Such discount and promotional coupons that rely on "bulk" mass mailings are considered advantageous if the cost per thousand ratio is taken into account. The goal therefore of mass media advertising is to reach the most suitable advertisers at the lowest possible cost per contact.

In addition to the "bulk" mail distribution of manufacture coupons there has also developed a sophisticated direct mail targeting of specific groups of consumers who through past and present purchases defined themselves into specialized consumer groups of similar purchasing potential.

In this area, coupons are inserted into billing envelopes, order forms and other analogous direct mailings.

Additionally, a medium use for distribution of advertising and coupons in the prior art is a so-called co-op mailing inserts. In this form of advertising distribution several coupons from several unrelated manufacturers or retail outlets are grouped together and inserted into a single envelope. Typically each insert is charged a fixed price according to the quantitites delivered. Such prior art distribution systems are typically labeled or categorized as "junk" mail by consumers easily identiable as such and thus easily discarded by the consumer.

Prior art patents have been issued on a variety of specialized advertising envelope constructions that include return envelope insert forms for original mailing containers, see for example U.S. Pat. Nos. 3,288,350, 3,334,806, 3,460,743, 4,781,322 and 5,035,515.

In U.S. Pat. Nos. 3,288,350 and 3,334,806 a portion of the specific configured envelope is detachable having advertising copy thereon.

U.S. Pat. No. 3,460,743 describes an envelope with an insert coupon wherein a coupon is removably secured within a pocket in the envelope secured by adhesive material.

U.S. Pat. No. 4,781,322 claims a kit for direct mail solicitation having a first window envelope and a second window envelope and insert. The second envelope is sized for insertion into the first and inserted correspondingly into the first and second envelopes by multiple sections with identification thereon.

Finally, in U.S. Pat. No. 5,035,515 a packaging with detachable coupon compartment is illustrated and described.

SUMMARY OF THE INVENTION

A method and apparatus of direct mail distribution of manufacturers and retailers promotional coupons that are redeemable in the purchasing of goods and services. The method of the invention is designated to incorporate the use of a U.S. postage prepaid stamped mailing envelope that is formed from a pre-printed envelope blank having a plurality of coupons printed thereon. The method of the invention distributes the postage prepaid envelope with associated coupons to mailing users at a cost less that that of the envelope and postage heretofore used. This method achieves economic viability by the sale of coupon space to the manufacturer and retailers in the prepaid postage envelope utilized in the method of the invention.

DESCRIPTION OF THE PREFERRED EMBODIMENT

The method of distributing printed discount coupons or promotional literature to a large number of selected potential customers by use of a self-contained postage paid mailing envelope system contrast with that of prior art distribution system in which many manufacturers use a variety of incentives to stimulate sales of their goods and services. Discount coupons are among the most common incentives wherein the customer receives a "discount" price for the product or service by use of the redeemable coupons.

Figure 1:
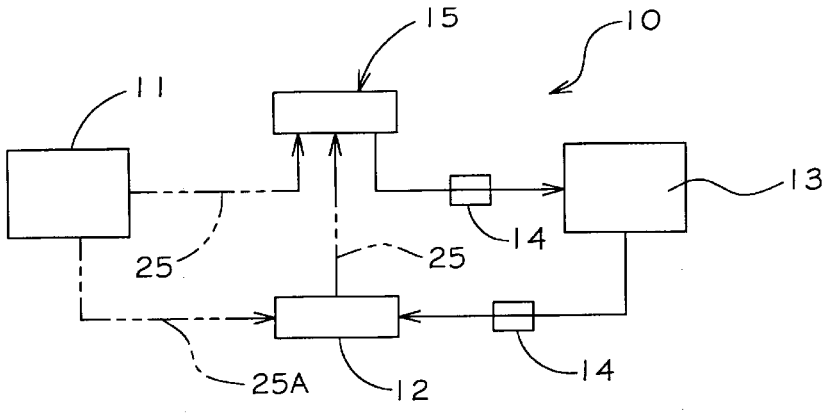
PRIOR ART FIG. 1
FIG. 1 is a method flow chart of the prior art method of distribution of coupons.
Figure 2:
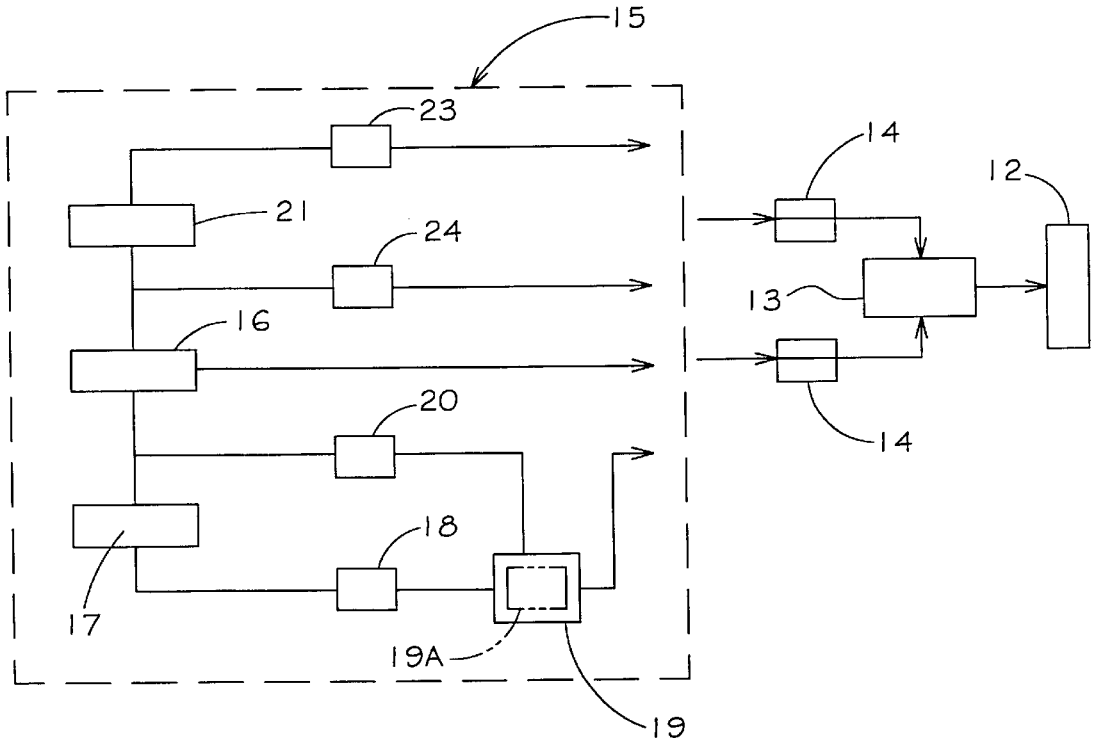
FIG. 2 is a progressive flow chart of prior art distribution systems illustrated generally in FIG. 1.

The retail store receives a rebate in the amount of the coupon plus a handling fee from the coupon issuer. Prior art distribution and redemption systems of coupons are illustrated generally in FIG. 1 of the drawings. A prior art distribution system 10 defines a manufacturer 11, the retail store outlet 12 and the consumer 13. The redemption vehicle chose for illustration is a value coupon 14. The coupons 14 are distributed to the consumer 13 by a variety of different methods generally indicated at 15 as best seen in FIG. 2 of the drawings which include newspaper advertisments 16 in which the consumer 13 is required to retrieve the coupons 14 from the newspaper. Alternate distribution systems characterized by manufacturers use of direct mail 17 distribution in which coupons 14 are enclosed in coupon letters 18 mailed by bulk rates through the U.S. postal service 19. Other direct mail distribution of coupon use ancillary mailing 20 such as inserts into existing billing statements where the billing entity advertises their own products or services or coupons inserts of others. Also used are coupon hand-outs indicated at 21 such as point of purchase coupon dissemination machines 23 found in retail establishments such as grocery stores (not illustrated) and the like and the home delivery system 24 in which coupons 14 are included along with advertising material delivered directly to the consumer's home by hand delivery.

Referring back to FIG. 1, it will be seen that all of the above described prior art systems have a cost assumed by the manufacturer 11 to pay for such coupon distribution based on the cost per thousand represented by the return arrow shown in broken lines at 25. Therefore associated cost of prior art coupon distribution systems are calculated by the cost per thousand and the net coupon redemption rate indicated at broken arrow 25A.

Figure 3:
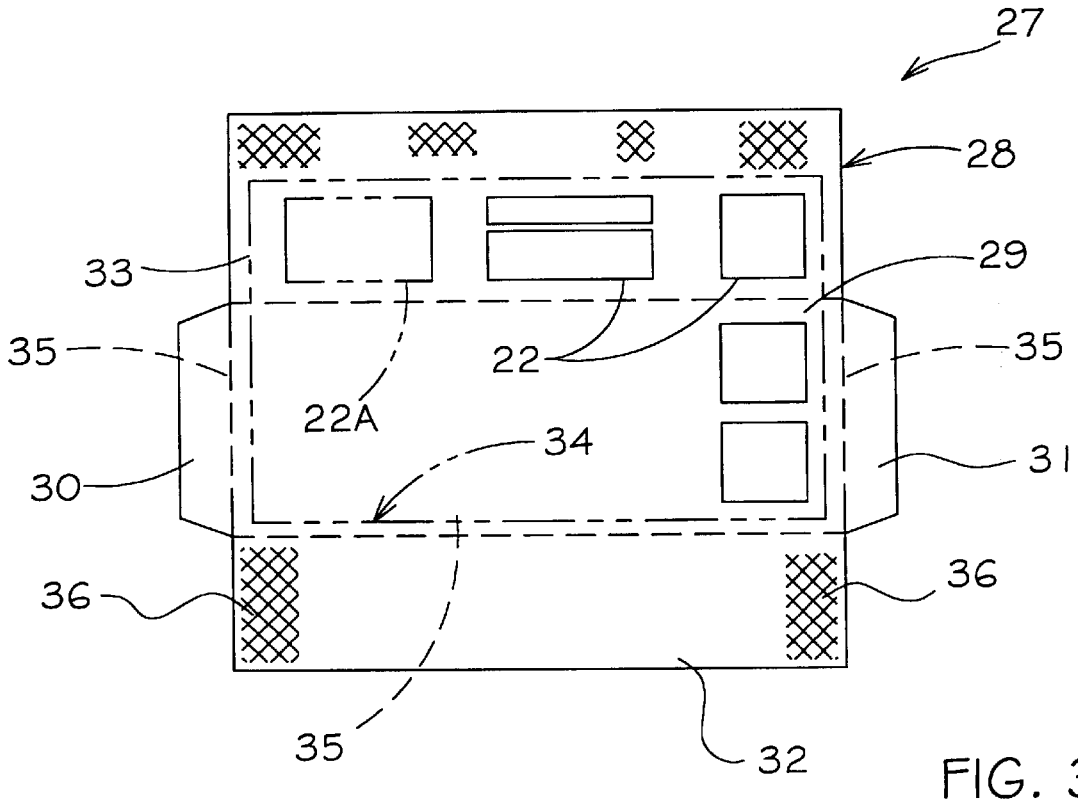
FIG. 3 is a top plan view of the envelope mailer blank of the method of the invention.
Figure 4:
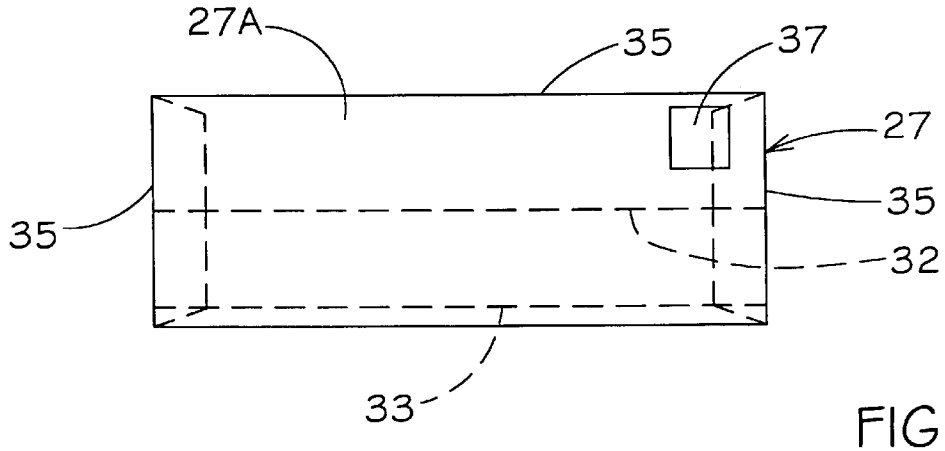
FIG. 4 is a front plan view of the assembled envelope mailer of the invention.
Figure 5:
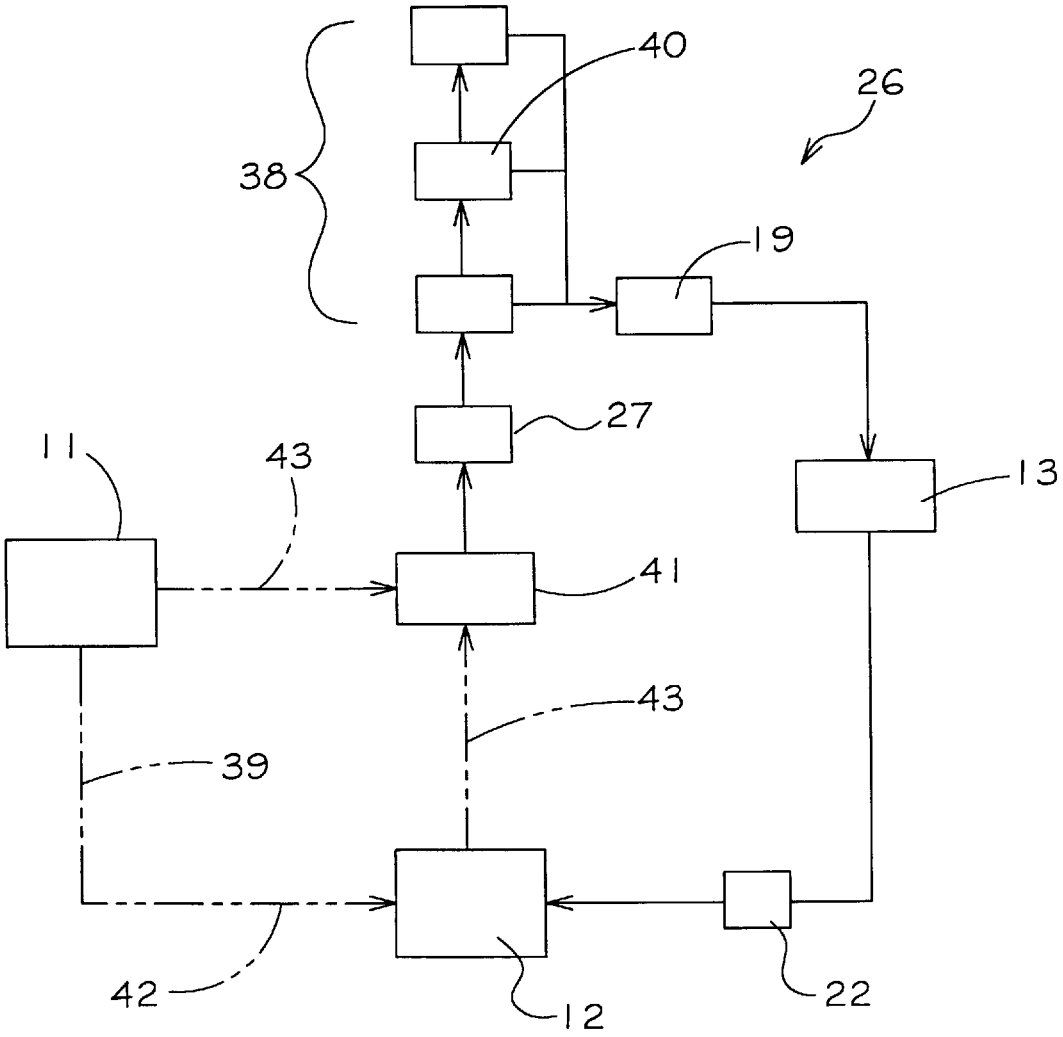
FIG. 5 is a process flow chart of the method set forth in the invention.

Referring now to FIGS. 3–5 of the drawings, the coupon distribution method of the invention can be seen as indicated generally at 26. The coupon distribution system 26 includes a coupon envelope mailer 27 which is formed from an envelope paper blank 28 that has a main body member 29, a pair of oppositely disposed end flaps 30 and 31 with a return bottom flap 32 and a pre-gummed outside top closure flap 33 as is typical in envelope construction.

The envelope blank 28 is pre-printed on its inside surface with redeemable coupon indecia 22 within a coupon area defined by the broken line 34. The "coupon area" defined by the broken line at 34 is sold to both the manufacturer 11 and retail outlets 12 in the same manner as advertising space is sold based on consumer criteria to be targeted by the select distribution achieved by the coupon envelope mailer 27 of the method of the invention as will be described in greater detail hereinafter.

In addition, coupon indecia 22 can also be printed on the outside surface 33A of the top closure flap 33 indicated by broken lines in FIG. 3 of the drawings To complete the envelope mailer 27, the paper blank 28 is folded along respective fold lines 35 and sealed along sealing areas 36 indicated by cross hatching to form an envelope construction hereinbefore described.

The assembled coupon envelope mailer 27's outside surface 27A as seen in FIG. 4 of the drawings is then stamped with a U.S. postage stamp or pre-printed with a prepaid first class postage permit indication at 37 thus defining the coupon envelope mailer 27 of the distribution system of the invention.

Referring now to FIG. 5 of the drawings, a method of coupon distribution of the invention can be seen wherein the coupon envelope mailer 27 of the method is sold to a mail user 38 at a cost defined as less than that of the prepaid postage 37 and standard envelope cost combined. The coupon envelope mailer 27 is then distributed by the mail user 38 via the U.S. postal mail service 19 to the targeted consumer 13. The coupons 22 of the coupon envelope mailer 27 are redeemable at the retail store and service outlets 12 as per usual process with the outlets 12 being reimbursed by the manufacturer 11 as indicated by broken lines at 39 in FIG. 5 of the drawings.

The method of the invention becomes viable for all parties in that both the manufacturer 11 and the retailer service outlet 12 can by buying coupons 22 within the coupon area 34 on the coupon envelope mailer 27 that will be targeted to specific consumer demographics defined by a specific mail user 38 who distributes the coupon envelope mailers 27 which are used for billing accounts in such examples as utilities, large discount stores or chains and specialty retailers defined by confirmation invoice or related mailings. A coupon envelope mailer producer 41 by providing a postage paid coupon envelope mailer 27 to the mail user 38 at a cost less than that of the current cost of a standard mailing envelope and associated postage, an incentive is created to use the coupon envelope mailer 27 of the method of the invention as will be well understood by those skilled in the art.

It will also be possible to selectively match coupon subject material to a specific mailer user as well as provide a user 40 with a selection of coupon subjects that would be appropriate to their identified customer. This mix and matching of coupon content with the mail users 40 will further enhance and be beneficial to both the manufacturer i.e. coupon buyer; the coupon envelope mailer 27 and the mail user 40. The manufacturer 11 rebates and compensates the retail outlet 12 for the envelope mailer coupon 22 in the usual form and is generally indicated by the broken line at 42 in FIG. 5 of the drawings. As set forth above, the retailer 12 and the manufacturer 11 can "buy" coupons 22 in the coupon envelope mailer 27 from the coupon envelope mailer producer 41 which are selectively indicated to the mail user and such compensation is referred to and indicated by broken arrow line 43.

It will be seen that the method of the invention described herein can also be applied to private carrier over-night delivery services 19A shown in broken lines in FIG. 2 of the drawings, using the same pre-paid mailer approach as hereinbefore described.

It will thus be seen that a new method and apparatus for delivering value coupons to the consumer has been illustrated and described and it will be apparent to those skilled in the art that various changes and modifications may be made therein without departing from the spirit of the invention.

Therefore I claim:

1. A method of selectively redeemable coupon distribution comprises the method steps of a. imprinting an envelope with redeemable coupons indicia thereon b. affixing U.S. postage on the envelope wherein said envelope with said postage is of a first monetary value c. distributing the envelope to a mailing user at a second monetary value d. selling the coupon indicia within said envelope to manufacturers and retailers of good and services represented by said coupon indicia wherein said selling of the coupon indicia is of a thrid monetary value e. receiving a profit defined by difference between said third monetary value compared to the difference between said first and second monetary values.

2. The method as recited in claim 1 for selective redeemable coupon distribution further comprises;

matching coupon indecia respective manufacturers and retailers to specific mailing entities.

3. The method as recited in claim 1 wherein said affixing U.S. postage on said imprinted envelope comprises;

a first class U.S. postage rate.

4. The method as recited in claim 1 wherein the mailing entity has a select customer base.

5. The method as recited in claim 5 further comprises retrieving said coupons indicia from said envelope and redeeming said coupons indicia with said manufacturers and retailers.

* * * * *